United States Patent [19]

Westrom et al.

[11] 4,413,246

[45] Nov. 1, 1983

[54] METALLIC COATING FOR A CADMIUM FUSE

[75] Inventors: Arthur C. Westrom, Stone Mountain; Billy R. Livesay, Atlanta; James W. Larsen, East Point, all of Ga.

[73] Assignee: Kearney-National Inc., Atlanta, Ga.

[21] Appl. No.: 296,986

[22] Filed: Aug. 27, 1981

[51] Int. Cl.[3] ..... H01H 85/04

[52] U.S. Cl. ..... 337/159; 337/161; 337/290

[58] Field of Search ..... 337/158, 159, 161, 280, 337/290, 293, 295

[56] References Cited

U.S. PATENT DOCUMENTS

| | | | |
|---|---|---|---|
| 1,157,919 | 10/1915 | Arsem | 337/280 |
| 1,208,448 | 12/1916 | Arthur | 337/290 |
| 3,529,270 | 9/1970 | Kozacka | 337/248 X |

*Primary Examiner*—George Harris
*Attorney, Agent, or Firm*—Rodgers & Rodgers

[57] ABSTRACT

For interrupting all values of electric current in a high voltage circuit which cause operation of a fuse within one hour, a plurality of parallel connected helically configured fusible elements formed of cadmium are embedded within quartz sand in granular form disposed within a housing structure which includes a tubular member of insulating material to the ends of which terminal caps are secured and connected to the ends of the fusible elements respectively so that currents of a high order of magnitude are interrupted in a fraction of a half cycle in a current limiting fashion and so that currents of a low order of magnitude and which are slightly in excess of normal rated load current of the fuse cause the temperature of the fusible elements to rise to the melting point within a longer predetermined period of time and then to establish a gap sufficient to withstand the recovery voltage. For substantially preventing degradation processes in the cadmium fusible elements, a non-porous metallic coating of substantially uniform thickness between 0.5 and 10 microns is arranged to cover each fusible element and wherein there is substantially no inter-metallic diffusion through the interface between the cadmium fusible elements and their metallic coatings at temperatures below the melting temperature of cadmium.

15 Claims, 5 Drawing Figures

METALLIC COATING FOR A CADMIUM FUSE

TECHNICAL FIELD

This invention relates to electric fuses which may be categorized as being of the high voltage general purpose current limiting type such as are disclosed in U.S. patent application Ser. No. 112,733 filed Jan. 17, 1980 by Vojislor Narancic.

BACKGROUND ART

According to known practice a fuse is provided which is capable of interrupting all currents from the rated maximum interrupting rating down to the rated minimum interrupting rating and which is connected in series with a so-called weak link expulson fuse which is specially designed to effect interruption of currents below the value of the minimum interrupting current rating of the current limiting fuse. Obviously it is desirable to eliminate the practice of requiring the use of two fuses.

Another widely used system for maintaining low temperature operation of a fuse utilizing silver fusible elements utilizes the so-called Metcalf or M effect. In this type of fuse, a silver ribbon is modified by the placement of a small deposit of tin or tin alloy at one point on the silver ribbon to form an eutectic alloy with the silver to promote melting at that point on the ribbon when it reaches a temperature of approximately 230° C. In the absence of the M effect, silver elements melt at a temperature of approximately 960° C. Obviously melting temperatures of such a high order of magnitude without the eutectic effect are destructive to the fuse and are counter productive to desirable fuse operation. Where the M effect is utilized, the melting of the silver ribbon is localized at that point and the resulting arc and continued current flow must increase the ribbon temperature by an additional 700° C. approximately. In addition nonmelting current flows can cause the alloy formation at the M spot to produce a permanent change in the fuse melting characteristic.

In one modification of the eutectic design, a parallel slave element is provided for the purpose of initiating two further breaks in the fusible element following the initial establishment of melting at the M spot. Such structure limits the points of melting to three and obviously is not altogether desirable and also introduces a degree of complication.

In accordance with another practice, a core is provided on which the fusible elements are wound and is constructed of gas evolving material. Where this type of structure is used venting of the housing is required. If the housing is vented of course the interrupting operation is not isolated and can result in failure of the fuse or damage to other apparatus.

Still another type of fuse utilizes a silver element connected in series with a tin element. The tin element is enclosed in an insulating tube and is expelled from the tube into the filler element to achieve low current interruption. Obviously this structure involves a measure of complication, and in addition is only suited for lower current ratings.

Still another practice has involved thermally insulating a silver wire section arranged in series with a silver ribbon. The heat concentration promotes earlier melting of the silver wire. It adds substantially to the cost of the fuse.

Still another practice has involved the use of a gold alloy in an arc quenching tube connected in series with a silver element so as to aid in the interruption of low currents.

From the above discussion of prior practices, it is evident that there are difficulties involved in interrupting low values of current. Furthermore the requirement for interrupting low currents has added substantially to the complexity of fuse designs, to their size and cost. It also limits their maximum current ratings and their application.

A fuse having fusible elements formed of cadmium is free of most of the objectionable features of the prior art but is not entirely satisfactory because of the tendency of cadmium to sublimate.

U.S. Pat. No. 3,838,376 Norholm discloses a fuse in which a core of cadmium is embedded within and partially surrounded by aluminum. The function of this structure is to explode and thus to interrupt an electric current and the sheath is thick and heavy.

DISCLOSURE OF INVENTION

According to this invention in one form, an electric fuse is provided for interrupting an electric current of predetermined magnitude in a high voltage electric circuit wherein the electric current is passed through a fusible element to cause the temperature of the fusible element to rise throughout substantially its entire length to a temperature approximating the melting temperature thereof within a predetermined time so that initial severance of the element and subsequent establishment of an arc occurs at a point along the length of the element and the remaining parts of the fusible element are melted due to direct contact with the initially established arc and by thermal conduction from the arc to parts of the fusible element remote from the arc and by continued flow of current through such remote parts so as to establish additional series arcs resulting in a gap sufficient to withstand the recovery voltage. The element is also arranged to function as a current limiting device within a brief period of time such as a fraction of a cycle in an alternating current system for currents of substantial magnitude which are typically many times the rated load current of the fuse. The fusible elements are formed of cadmium of a purity between 95% and 99.999% and the fusible elements are embedded within and supported by granular filler disposed within and substantially filling a housing structure formed of insulating material and having terminal caps to which the ends of the fusible element are connected respectively.

In accordance with a principal feature of this invention, the tendency of cadmium to sublimate is substantially prevented by the application of a coating formed of a metal having a higher melting temperature than cadmium and which is selected from a group consisting of nickel, iron, aluminum, chromium, manganese and beryllium.

BEST MODE OF CARRYING OUT THE INVENTION

Figure 1:
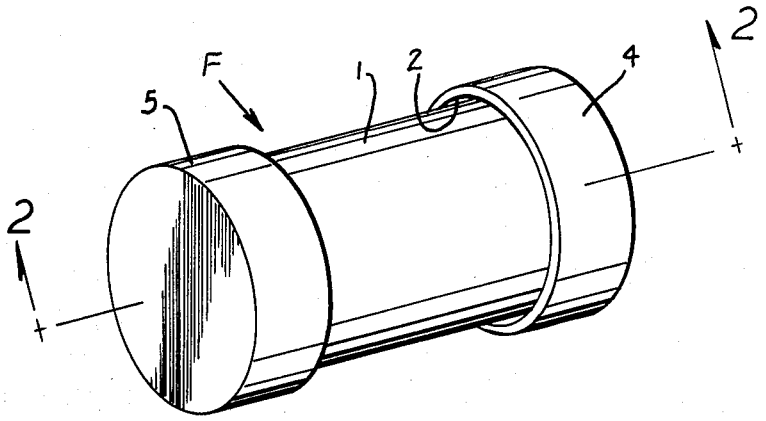
FIG. 1 is a perspective view of a fuse constructed according to one form of this invention.

In the drawings the numeral 1 designates a tubular housing formed of insulating material. End caps 2 and 3 are disposed at opposite ends of the tubular housing 1 and are formed of suitable conducting material. Outer caps 4 and 5 are secured about the end caps 2 and 3 by a pressed fit and the end caps 2 and 3 are secured to the tubular housing 1 by means of cement 6 and 7. End terminal sleeve 8 and terminal cap 9 are secured to the inner surfaces of inner caps 2 and 3 and are disposed within central apertures formed within end caps 2 and 3. The housing structure is filled with quartz sand 10 which preferably is in the form of approximately spherical grains of random size within a given range.

Figure 2:
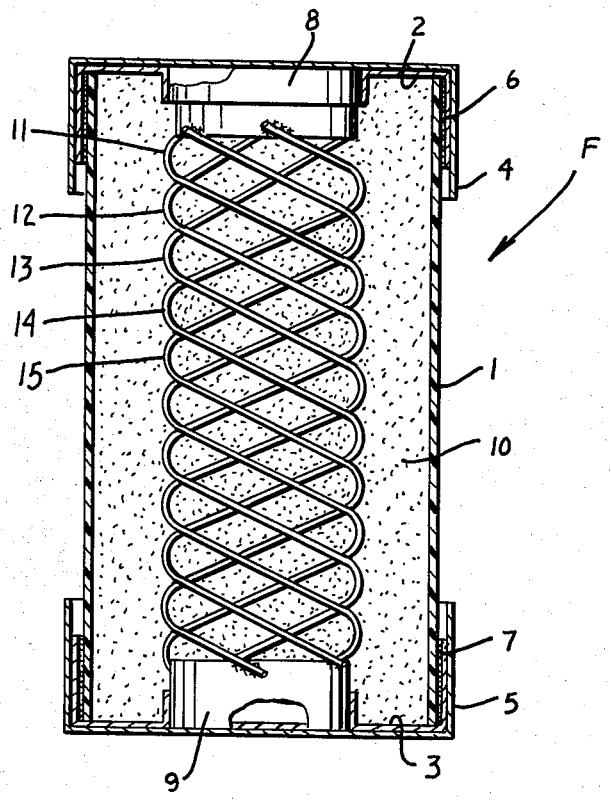
FIG. 2 is a longitudinal cross-sectional view of the structure shown in FIG. 1 with portions thereof broken away.

Disposed within the housing of the fuse and embedded within and supported by the granular filler 10 are a plurality of helical fusible elements 11–15. As is apparent from FIG. 2 these helical elements 11–15 are arranged with their ends connected with the terminal sleeve 8 and terminal cap 9 respectively. Sleeve 8 and cap 9 thus constitute terminal elements. The portions of the fusible elements intermediate their ends are supported by the granular filler 10.

Figure 3:
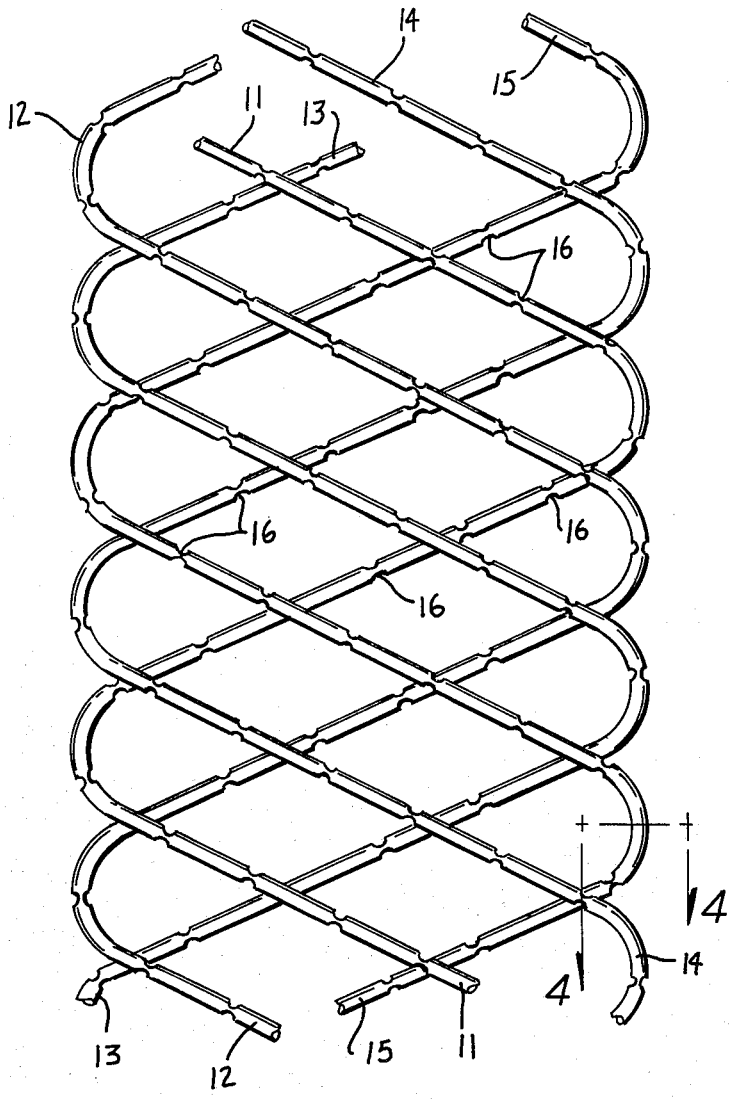
FIG. 3 is an enlarged view depicting the details of construction of the fusible elements shown in FIG. 2.

As is apparent from FIG. 3 the fusible helical elements 11–15 are provided with notches 16 which are disposed along the length of each fusible element. Each fusible element 11–15 may be in the form of a wire of generally circular cross section or may be in the form of a ribbon.

Since the invention is concerned with high voltage circuits of 1,000 volts and above, it is herein categorized as a high voltage fuse.

In the event of the occurrence of a high magnitude fault current such as many times rated load current, the fusible elements 11–15 melt practically simultaneously at all of their reduced sections 16 to form a chain of arcs. These arcs quickly lengthen and burn back from their roots.

While this invention is not limited to a fuse having a plurality of fusible elements, the use of a plurality of parallel connected elements embedded within the granular filler 10 is beneficial in cooling the elements during normal current carrying conditions so that the more efficient the cooling the lower the total cross section of the elements required for a given current rating.

The use of a plurality of elements is particularly beneficial in effecting interruption of currents of low magnitude which are but slightly in excess of the normal load current of the fuse. Under such low current conditions, one element melts at one pointsuch as a notch 16 before the other elements melt. Unlike the situation involving extremely high currents, melting occurs first in one position only and in only one element. The result is a short break in the melted element. Since this short break is in parallel with the remaining elements, no arcing takes place at the initial break and the current from the first element to break is then shared between the remaining elements. Subsequently another element melts under similar conditions and its current flow is then shared between the remaining elements. All of the elements melt in sequence and with the melting of each successive element, a correspondingly higher current flow and density occurs in the remaining unmelted element or elements.

When the last remaining element melts, the fuse then begins to arc. Under low current conditions, arcs do not burn in parallel and all of the current is concentrated into one arc path. Such arcing commences in the element which offers the most attractive path and as greater arc length is achieved, the current changes to another path which becomes more attractive. The commutation of current under these conditions is a known phenomena but as far as is known has never been previously demonstrated by photographic and oscillographic means in high voltage fuses. Establishment of an arc in one fusible element allows the arc to lengthen quickly because the fusible element is at substantially its melting temperature throughout its entire length. Thus an arc in a fusible element may rapidly burn back substantial portions of the length of the element and cause melting not only at the notched part 16 but at the portions located between those notches. This rapid burn back and additional element melting with new arcing from an initial arc in a fusible element is due to direct contact with the arc of parts of the fusible element adjacent thereto as well as to the transfer of heat by thermal conduction and by the continued flow of current through portions of the fusible element remote from the arc. This rapid element consumption is particularly effective because the fusible element is already very near the melting point in accordance with one facet of the invention. Tests have clearly demonstrated that not only are the arcs restricted to one path at one instant but they are highly mobile and commutate at any point on the current wave. Once the commutation phase is completed all of the fusible elements are melted throughout substantial portions of their length. The resulting gaps are sufficient to withstand the recovery voltage and the circuit current of very low magnitude is effectively interrupted.

From the description above it is apparent that an essential feature of the invention concerns the particular material chosen for the fusible elements. The material chosen should have a low melting point of 350° C. or less in order to achieve effective interruption of currents of a low order of magnitude. The oxide formed should have a high resistance so as to aid in establishing good dielectric strength after extinguishing the arc. Tests have indicated that cadmium is a very desirable material. The purity of cadmium may be between 95% and 99.999%. Cadmium has a relatively low melting point of approximately 321° C. and also a relatively low temperature of evaporation of approximately 750° C. In addition when vapor of cadmium is oxydized and cooled by the granular filler, it results in a good insulator. In the case of small currents, cadmium fusible elements are generally melted throughout substantially their entire length and thus an effective inhibition of restrikes by the recovery voltage is achieved.

Pure cadmium metal is found susceptible to four primary degradation mechanisms under typical fuse operating conditions:

1. Sublimation
2. Corrosion
3. Mechanical Fatigue
4. Fretting Wear

The above mechanisms are aggravated by continually changing temperature conditions of the fusible elements caused by changing load currents and the resulting small movement of the elements relative to the sand in which they are embedded.

Since cadmium has not been used in the construction of high voltage current limiting fuses it was desirable to investigate the long term aging of the material under conditions of elevated temperatures. The material was tested in controlled atmospheres and was found to sublimate at a very high rate in a vacuum at elevated temperatures. The rate of sublimation was also determined in oxygen and in nitrogen and combinations thereof and it was concluded that the pure metal would exhibit an unsatisfactory life in a high voltage general purpose fuse environment.

Figure 5:
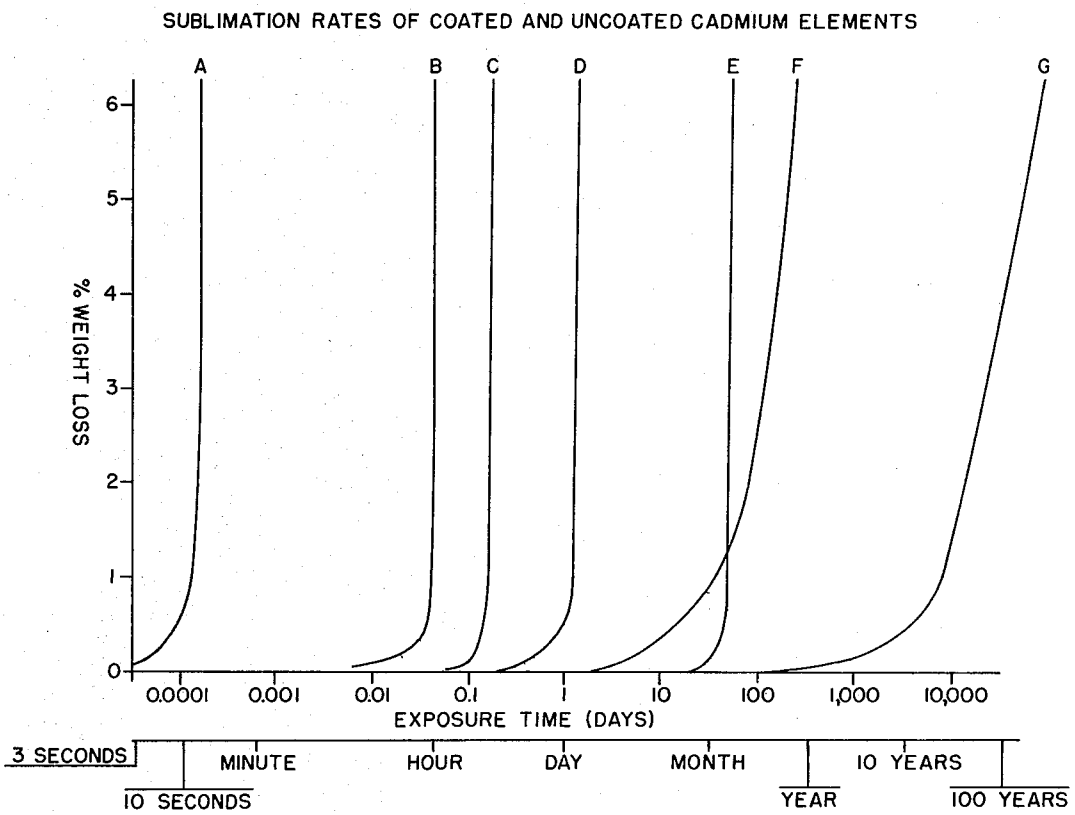
FIG. 5 is a group of weight-loss characteristic curves of cadmium fusible elements with and without coatings and under various conditions.

Six metals were then selected to be used as coatings to effectively mitigate the sublimation. The selected coatings were metals that would not undesirably diffuse into the cadmium. The coating is applied after the element is notched to insure overall protection. The sublimation rate test projections based on automatic microbalance measurements to an accuracy of $10^{-7}$ grams and with complete environmental control are shown in the following tabulation which corresponds to FIG. 5:

| Test Sample & Pre-Treatment | Sealed Atmosphere | Temperature | Estimated Time to Produce 5% Loss | Maximum Loss Rate Per 1% |
|---|---|---|---|---|
| (A)Cleaned Cd | VACUUM | 150° C. | 10 seconds | <2 seconds |
| (B)Cd, exposed to $N_2$ | VACUUM | 150° C. | 1 Hour | <2 seconds |
| (C)Cd, exposed to air | VACUUM | 150° C. | 6 Hour | <2 seconds |
| (D)Cleaned Cd | AIR, ½ ATMOSPHERE | 150° C. | 1 Day | <1 minute |
| (E)Cd, exposed to air | AIR, 1 ATMOSPHERE | 150° C. | 50 Days | <4 minutes |
| (F)Cd, Ni coated | VACUUM | 150° C. | 200 Days | <40 days |
| (G)Cd, Ni coated | AIR, 1 ATMOSPHERE | 150° C. | >100 Years | >20 years |
| (H)Cd, Al coated | VACUUM | 150° C., 180° C., | no measurable change | |
| (I)Cd, Al coated | AIR, 1 ATMOSPHERE | 150° C., 180° C., | no measurable change | |

According to this invention, the metal of the coating must have a melting temperature greater than the melting temperature of cadmium and there can be no significant inter-metallic diffusion of the coating material into the bulk of the cadmium element in order to prevent changes in desired bulk properties of the cadmium. The coating must be substantially non-porous and substantially uniform in thickness and should be of a thickness between 0.1 and 10 microns. Also the coating must not sublimate at temperatures below the melting temperature of cadmium.

In accordance with this invention, the metallic coating is a metal chosen from the group consisting of nickel, iron, aluminum, chromium, manganese or beryllium. Tests have shown that nickel, chromium or aluminum are particularly effective in substantially eliminating sublimation in a fusible element formed of cadmium and coated with either of these metals. These coatings also provide corrosion protection, mechanical strengthening and fretting wear resistance.

Figure 4:
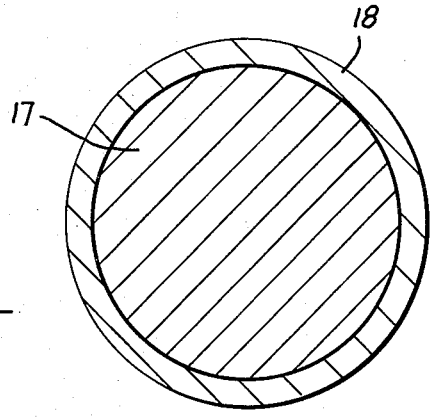
FIG. 4 is an enlarged cross-sectional view taken along the line 4—4 in FIG. 3

The coating may be applied by electroplating, by vacuum deposition techniques or by an electroless process. In FIG. 4 the cadmium is designated by the numeral 17 and the coating is designated by the numeral 18.

INDUSTRIAL APPLICABILITY

A fuse constructed according to this invention is well suited for use in protecting liquid filled apparatus such as transformers, capacitors, switchgear and the like. By the invention a fuse is provided which is capable of effective fast acting current limiting action for currents of high magnitude and which also operates reliably for low currents which are but slightly in excess of the normal rated current of the fuse due in part to the fact that the fusible elements may be raised by relatively low fault currents to temperature levels approaching melting without establishing an excessively high overall fuse temperature, which may be destructive to the fuse itself or damaging to insulating components adjacent to the fuse. Durability is enhanced by the coating applied to the fusible element according to this invention. Under normal full load conditions, the temperature of a fusible element does not substantially exceed 150° C. Ordinarily a fusible element constructed according to this invention maintains at least 95% of its initial weight and volume at temperatures not substantially exceeding 150° C. for the normal life of the fusible element.

We claim:

1. A fusible element for use in an electric fuse, said fusible element comprising an elongated element formed of cadmium and a metallic coating having a thickness between 0.1 and 10 microns and covering substantially the entire exterior surface of said elongated element for effectively prohibiting pre-melting deterioration including sublimation, corrosion, mechanical fatigue and fretting of said elongated element, said metallic coating being substantially non-porous and being formed of a metal having a melting temperature greater than the melting temperature of cadmium and which does not significantly diffuse into the bulk of the cadmium element and is selected from a group consisting of nickel, iron, aluminum, chromium, manganese, and beryllium.

2. A fusible element according to claim 1 wherein said coating is formed of nickel.

3. A fusible element according to claim 1 wherein said coating is formed of iron.

4. A fusible element according to claim 1 wherein said coating is formed of aluminum.

5. A fusible element according to claim 1 wherein said coating is formed of chromium.

6. A fusible element according to claim 1 wherein said coating is formed of manganese.

7. A fusible element according to claim 1 wherein said coating is formed of beryllium.

8. A fusible element according to claim 1 wherein said elongated element is constructed with a plurality of areas of reduced cross-section disposed along the length thereof and wherein said metallic coating is arranged to cover the entire exterior surface of said elongated element including said areas of reduced cross-section.

9. A fusible element according to claim 1 wherein said metallic coating is of substantially uniform thickness.

10. A fusible element according to claim 1 wherein said metallic coating does not sublimate deleteriously under atmospheric pressure at temperatures below the melting temperature of cadmium.

11. A fusible element according to claim 1 wherein said fusible element maintains at least 95% of its initial weight and volume at temperatures not substantially exceeding 150° C. for the normal life of the fusible element.

12. A fusible element for use in a general purpose current limiting electric fuse for circuits of at least 1000 volts, said fusible element comprising an elongated element formed of cadmium of 95% to 99.999% purity, and a metallic coating on said elongated element, the interface between said elongated element formed of cadmium and said metallic coating being such that substantially no metallic diffusion of the coating metal into the cadmium fusible element occurs at temperatures below the melting temperature of cadmium.

13. A fusible element for an electric fuse, said fusible element comprising an elongated element formed of cadmium, and a substantially non-pourous metallic coating covering said elongated element and being of substantially uniform thickness between 0.1 to 10 microns and there being substantially no metallic diffusion of the coating metal into the cadmium element at temperatures below the melting temperature of cadmium.

14. A general purpose, current limiting electric fuse for use in circuits of at least 1000 volts, said fuse comprising a tubular housing of insulating material constructed to withstand the circuit recovery voltage following a circuit interruption by the fuse, a terminal cap mounted on each end of said tubular housing and constituting closure elements thereof, quartz sand disposed within and substantially filling said housing, a plurality of helical fusible elements formed of cadmium of 95% to 99.999% purity embedded in and supported by said quartz sand and having their ends connected with said terminal elements respectively to form a plurality of parallel conducting paths therebetween, a substantially non-porous metallic coating covering said fusible elements and being of substantially uniform thickness between 0.1 and 10 microns and there being substantially no metallic diffusion of the coating metal into said cadmium elements at temperatures below the melting temperature of cadmium, said fusible elements being effective to melt and to interrupt currents many times the rated current of the fuse with a high degree of current limitation and said fusible elements being heated to a temperature approximating the melting temperature thereof by currents of low magnitude and slightly in excess of normal rated current to cause said fusible elements to melt in random sequence and arcs thereafter being established and extinguished in random sequence in said fusible elements via commutation action.

15. A fuse according to claim 14 wherein each of said cadmium fusible elements is constructed with a plurality of notches of reduced cross-sectional areas disposed along the length thereof and wherein said coatings are applied after notching of said fusible elements so as effectively to cover the portions thereof which are of reduced cross section.

* * * * *